US006903709B2

(12) United States Patent
Kawasaki et al.

(10) Patent No.: US 6,903,709 B2
(45) Date of Patent: Jun. 7, 2005

(54) PLASMA DISPLAY PANEL AND METHOD OF DRIVING THE SAME

(75) Inventors: Tatsuhiko Kawasaki, Kawasaki (JP); Hitoshi Hirakawa, Kawasaki (JP); Takashi Shiizaki, Kawasaki (JP); Takashi Sasaki, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 256 days.

(21) Appl. No.: 09/841,037

(22) Filed: Apr. 25, 2001

(65) Prior Publication Data

US 2002/0070906 A1 Jun. 13, 2002

(30) Foreign Application Priority Data

Dec. 8, 2000 (JP) ..... 2000-373748

(51) Int. Cl.[7] ..... G09G 2/28

(52) U.S. Cl. ..... 345/60; 345/41; 345/62; 345/66

(58) Field of Search ..... 345/60–63, 74, 345/76, 66, 68; 315/169.4, 167–169; 313/484, 491, 515, 517, 514, 520

(56) References Cited

U.S. PATENT DOCUMENTS 5,086,257 A * 2/1992 Gay et al. ..... 315/169.4
5,107,182 A 4/1992 Sano et al.
5,674,553 A * 10/1997 Shinoda et al. ..... 427/68
6,373,452 B1 4/2002 Ishii et al.
6,376,986 B1 * 4/2002 Takagi et al. ..... 313/582
6,400,082 B1 * 6/2002 Chikazawa ..... 313/584
6,498,593 B1 * 12/2002 Fujimoto et al. ..... 345/60

FOREIGN PATENT DOCUMENTS

JP 6-44907 2/1994
JP 11-312471 11/1999

* cited by examiner

*Primary Examiner*—Guy J. Lamarre
*Assistant Examiner*—Fritz Alphonse
(74) *Attorney, Agent, or Firm*—Staas & Halsey LLP

(57) ABSTRACT

A plasma display panel and a method of driving the same are provided in which circuit elements necessary for controlling potentials of scan electrodes can be reduced without using a complicated multilayered wiring. In the plasma display panel, k (k≧2) data electrodes, each of which is continuous from one end of a column to the other end, are arranged for each column of a matrix display. All scan electrodes in a display screen are classified into k groups, and one of k groups is assigned to k data electrodes in each column. Each data electrode is crossed with or opposed to scan electrodes belonging to the group that is assigned to the data electrode without overlapping a partition in a plan view and is crossed with or opposed to other scan electrodes with overlapping the partition.

12 Claims, 20 Drawing Sheets

PLASMA DISPLAY PANEL AND METHOD OF DRIVING THE SAME

BACKGROUND OF THE INVENTION

1. Field of the Invention

The present invention relates to a plasma display panel (hereinafter referred to as a PDP) and a method of driving the same.

A PDP is developed as a display device having a large screen. A 25-inch high definition monitor and a 60-inch TV set using the PDP have been put into practical use. A larger screen is required in the market, and techniques for satisfying the requirement are under development.

2. Description of the Prior Art

In a conventional AC type PDP display, cells arranged in a matrix are addressed in a linear sequential scanning format, in which an appropriate quantity of wall charge is formed only in cells to be lighted, and then the wall charge is used for generating display discharge at plural times corresponding to display gradation. An addressing period is proportional to the number of rows of a display screen (i.e., resolution in the vertical direction). Therefore, the higher the resolution is, the shorter the period that can be assigned to the display discharge in a frame period becomes. In addition, the number of division that a frame can be divided into for a gradation display decreases. In other words, it is difficult to realize high luminance and a large number of gradation steps in a high resolution PDP.

Conventionally, as a technique for shortening an addressing period, a "dual scan" method is known, in which a display screen 80 is divided into two areas vertically as shown in FIG. 20A, and two display areas 81 and 82 are addressed concurrently. Each data electrode is divided as a result of the division of the display screen 80, and column selection in the display area 81 or 82 is performed by the data electrode D1 or D2 corresponding to each display area 81 or 82. Since two rows are selected simultaneously in the dual scan, the addressing period is a half of that in the single scan in which only one row is selected at one time. Japanese unexamined patent publication No. 11-312471 discloses a technique in which the display screen 90 is divided into four areas as shown in FIG. 20B. In this technique, data electrodes D12 and D22 in display areas 92 and 93 located in the middle in the vertical direction are led out of the display screen 90 via display areas 91 and 94 located in the end portions so as to be connected with a driving circuit. In the display areas 91 and 94, data electrodes D11 and D21 are located so that an address discharge is generated between a data electrode and a scan electrode, while the data electrodes D12 and D22 are insulated by a partition 290 that defines discharge spaces so that a discharge is not generated. By dividing the display screen 90 into four areas, the addressing period can be shortened to one fourth.

According to the conventional technique of dividing data electrodes within the display screen, there are many rows that cannot be selected at the same time between the rows that can be selected simultaneously. For example, if a display screen having 1024 rows is divided into two areas by the dual scan, there are 511 (=1024/2−1) rows between the first rows of two display areas 81 and 82. In order to electrically connect scan electrodes corresponding to rows that can be selected simultaneously so as to reduce components of the driving circuit, multilayered wiring is required for crossing many scan electrodes. A rise in cost is inescapable when the multilayered wiring is used in any portion of a substrate constituting the PDP, a wiring cable connecting the PDP with a driving circuit board, and a driving circuit board.

Moreover, only one end of the data electrode is led out of the display screen. Therefore, if a data electrode breaks, cells that are located closer to the middle portion than the broken portion become unable to be controlled.

SUMMARY OF THE INVENTION

An object of the present invention is to reduce circuit elements necessary for controlling potentials of the scan electrodes without using complicated multilayered wiring.

In the present invention, k ($k \geqq 2$) of the data electrodes are arranged for each column of the matrix display, and the data electrode is continuous from one end of the column to the other end. All the scan electrodes within a display screen are classified into k groups, and one of the k groups is assigned to k data electrodes in each column. Each of the data electrodes is crossed with or opposed to scan electrodes belonging to the group that is assigned to the data electrode at positions that are not insulated by a partition (without overlapping a partition in a plan view) and is crossed with or opposed to other scan electrodes at positions that are insulated by the partition. Thus, k rows that can be selected at the same time are brought close to each other, so that the scan electrodes corresponding to these rows can be connected easily. A single layered wiring can be used for the connection regardless of the number of rows. There is no restriction of the place where the connection is performed. The connection can be performed in a substrate constituting a PDP, in a wiring cable connecting the PDP with the driving circuit board, or in a driving circuit board.

DESCRIPTION OF THE PREFERRED EMBODIMENTS

Hereinafter, embodiments of the present invention will be explained, in which the number k of data electrodes per column is set two.

[First Embodiment]

Figure 1:
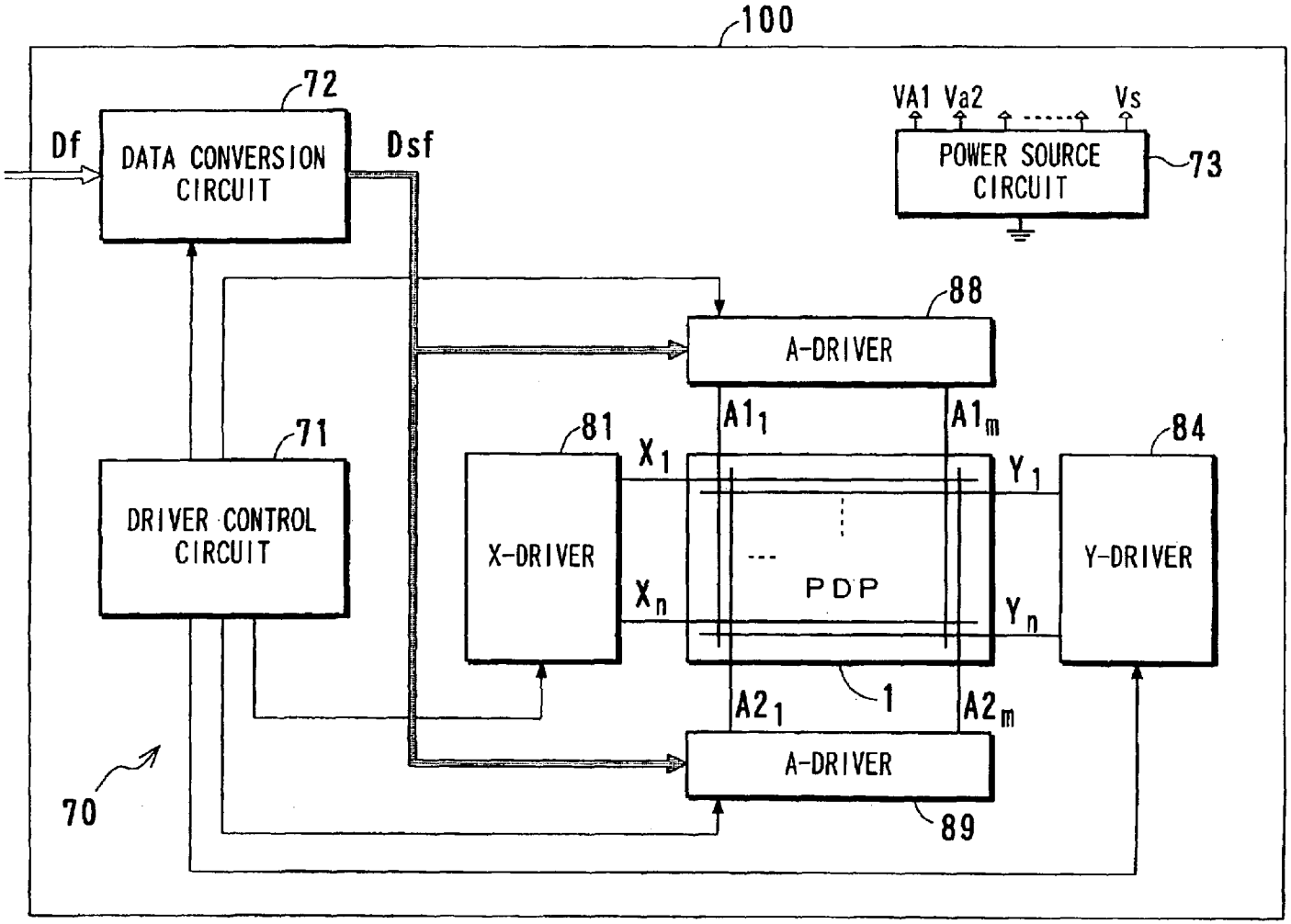
FIG. 1 is a block diagram of a display device according to the present invention.

FIG. 1 is a block diagram of a display device according to the present invention. The display device 100 comprises a surface discharge type PDP 1 including a display screen having m×n cells and a drive unit 70 for controlling light emission of each cell. The display device 100 is used as a wall-hung TV set or a monitor display of a computer system.

The PDP 1 includes display electrodes X and Y arranged in parallel constituting an electrode pair for generating a display discharge and address electrodes A1 and A2 arranged to cross the display electrodes X and Y. The display electrodes X and Y extend in the row direction of the screen (i.e., in the horizontal direction), while the address electrodes extend in the column direction (i.e., in the vertical direction). In FIG. 1, the suffixes (1, n) of the reference letters of the display electrodes X and Y indicate an arrangement order of the corresponding "row", and the suffixes (1, m) of the reference letters of the address electrodes A1 and A2 indicate an arrangement order of the corresponding "column". The row is a set of m cells having the same arrangement order in the column direction, and the column is a set of n cells having the same arrangement order in the row direction.

The drive unit 70 includes a driver control circuit 71, a data conversion circuit 72, a power source circuit 73, an X-driver 81, a Y-driver 84 and an A-drivers 88 and 89. The drive unit 70 is supplied with frame data Df indicating luminance levels of red, green and blue colors along with various synchronizing signals from an external device such as a TV tuner or a computer. The frame data Df are temporarily memorized in a frame memory of the data conversion circuit 72. The data conversion circuit 72 converts the frame data Df into the subframe data Dsf for gradation display and transmits the converted data to A-drivers 88 and 89. The subframe data Dsf are a set of display data having one bit per cell. A value of each bit indicates whether the cell should be lighted in the corresponding subframe, more specifically, whether an address discharge is required or not. Furthermore, in the case of an interlace display, each of plural fields constituting the frame is made of plural subfield, and the light emission of each subfield is controlled. However, the control of the light emission is the same as that of a progressive display.

Figure 2:
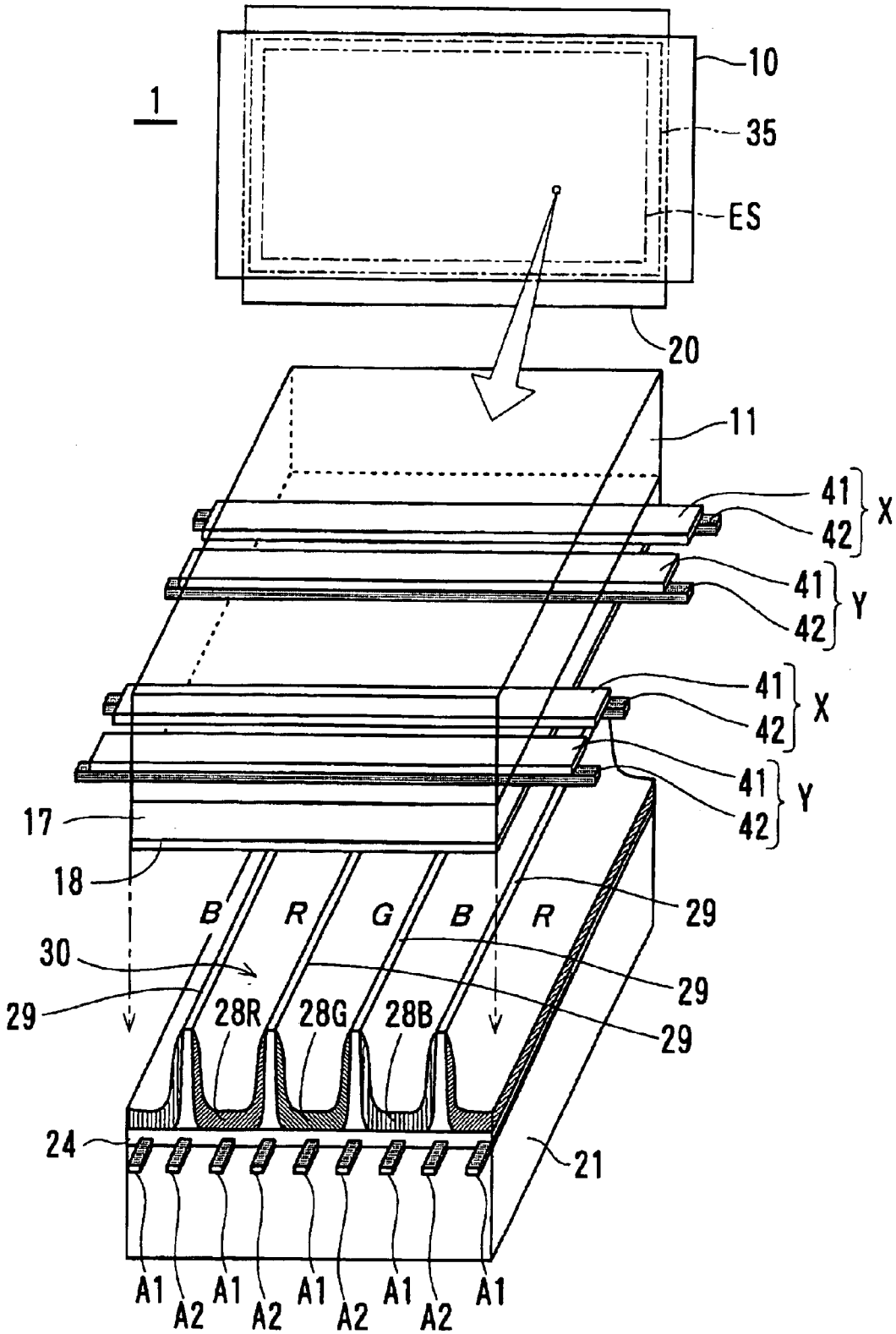
FIG. 2 is a diagram showing an example of a cell structure of a PDP.

FIG. 2 is a diagram showing an example of a cell structure of a PDP.

A PDP 1 comprises a pair of substrate structures (each of which has cell elements arranged on a substrate) 10 and 20, which are integrated by a sealing member 35. The inner surface of a front glass substrate 11 is provided with a pair of display electrodes X and Y per row of the display screen ES having n rows and m columns. Each of the display electrodes X and Y includes a transparent conductive film 41 for forming a surface discharge gap and a metal film 42 being overlaid on the edge portion of the conductive film 41. The display electrodes X and Y are covered with a dielectric layer 17 and a protection film 18. The inner surface of the back glass substrate 21 is provided with two address electrodes A1 and A2 per column. The address electrodes A1 and A2 are covered with a dielectric layer 24. Partitions 29 are formed on the dielectric layer 24 for defining a discharge space 30 of each column. The surface of the dielectric layer 24 and the side faces of the partitions 29 are covered with fluorescent material layers 28R, 28G and 28B for color display. The fluorescent material layers 28R, 28G and 28B are excited locally to emit light by ultraviolet rays that are generated by a discharge gas. The italic letters (R, G and B) in FIG. 2 indicate light emission colors of the fluorescent materials. The PDP 1 uses the display electrode Y as a scan electrode and the address electrodes A1 and A2 as data electrodes.

Figure 3:
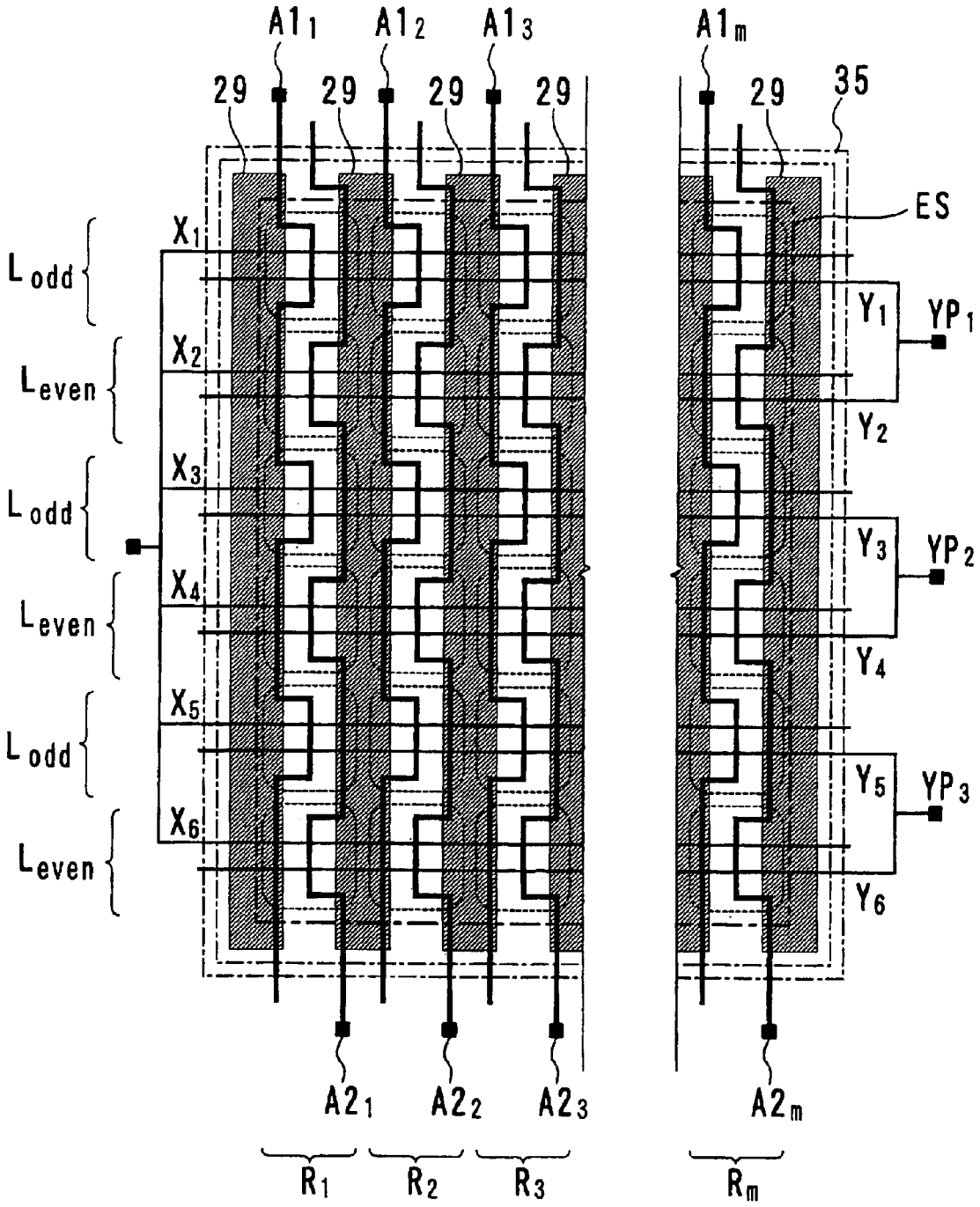
FIG. 3 is a schematic diagram of an electrode structure.
Figure 4:
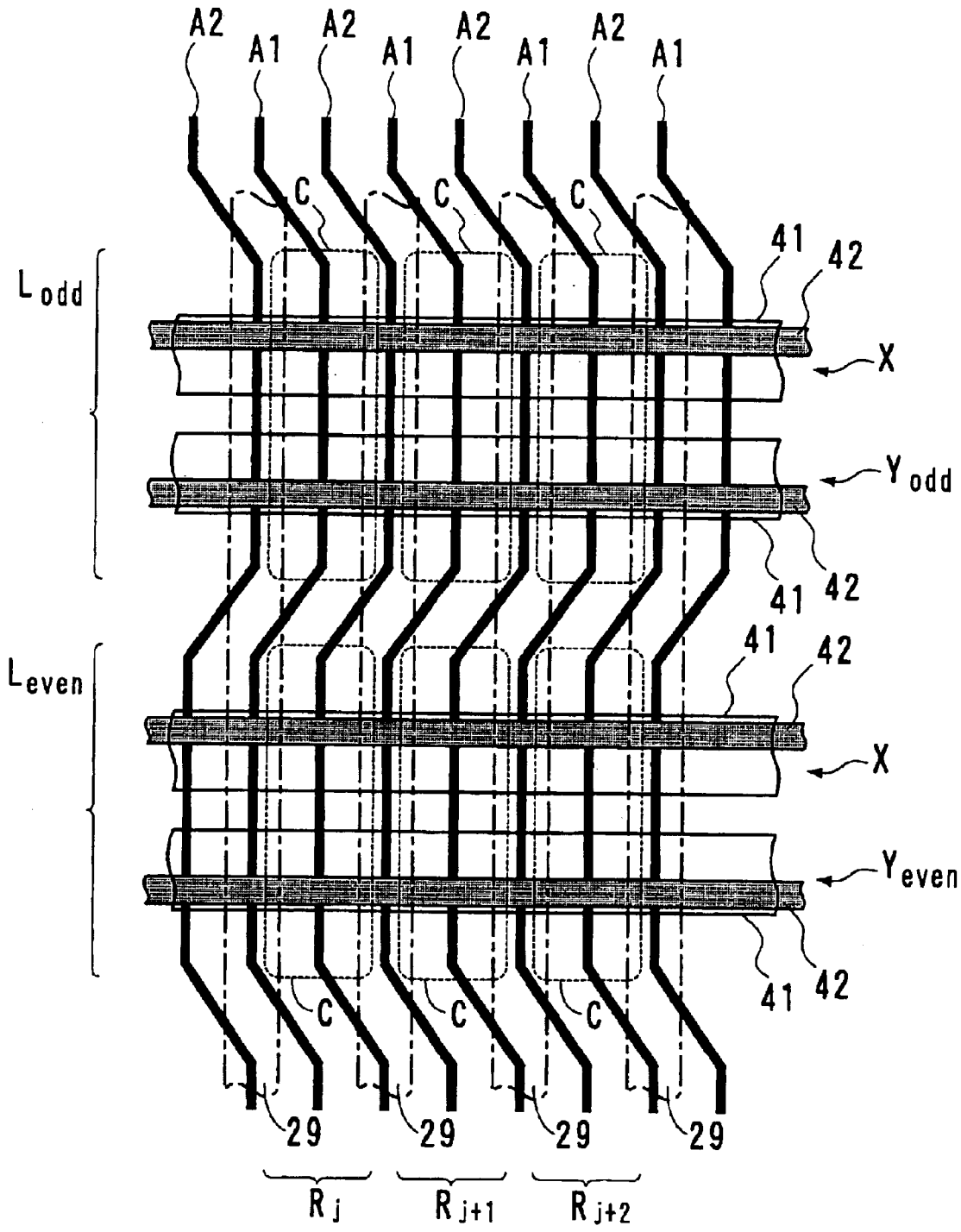
FIG. 4 is a plan view showing details of the electrode structure.

FIG. 3 is a schematic diagram of an electrode structure. FIG. 4 is a plan view showing details of the electrode structure. Though the display screen shown in FIG. 3 has six rows, the number of rows n is generally greater than several hundreds (for example, n is 1024 in the SVGA quality).

In each column $R_1, R_2, R_3, \ldots$ or $R_m$ of the display screen ES, each of the two address electrodes A1 and A2 is a band-like conductor being bent regularly and is continuous from one end of the column to the other end. The address electrode A1 crosses display electrodes $Y_{1,\ Y3}$, and $Y_5$ of odd rows $L_{odd}$ without overlapping the partition 29 in a plan view and crosses display electrodes $Y_2$, $Y_4$ and $Y_6$ of even rows $L_{even}$ with overlapping the partition 29. On the contrary, the address electrode A2 crosses display electrodes $Y_1$, $Y_3$, and $Y_5$ of odd rows $L_{odd}$ with overlapping the partition 29 and crosses display electrodes $Y_2$, $Y_4$ and $Y_6$ of even rows $L_{even}$ without overlapping the partition 29. In other words, the address electrode Al is so patterned as to generate the address discharge only in odd rows $L_{odd}$, while the address electrode A2 is patterned so as to generate address discharge only in even rows $L_{even}$. The overlapping portion of each electrode with the partition 29 does not form a discharge space and is an area that does not generate a discharge. In this portion, the partition 29 works as an insulator preventing a discharge.

By arranging the address electrodes A1 and A2 in each column $R_1, R_2, R_3, \ldots$ or $R_m$, it is possible to select any one of the odd rows $L_{odd}$ and any one of the even rows $L_{even}$ at the same time for addressing, so as to shorten the addressing period. In the PDP 1, display electrodes Y of neighboring rows are connected to each other (as a common wiring), so the neighboring rows are selected at the same time. Hereinafter, a set of connected two display electrodes Y is referred to as a "display electrode YP." The connection wiring of the neighboring rows can be realized easily by a single layered wiring, so a multilayered wiring is not required for the connection wiring. In order to form a metal film 42 of a display electrode Y for example, a conductor layer may be patterned so as to connect two display electrodes Y in order. By this connection wiring, the number of scan electrodes (display electrodes YP) to be controlled independently is reduced to a half of the number of the display electrodes Y. Therefore, the number of IC components constituting the Y-driver 84 can be reduced to a half of that in the conventional structure. If the number of rows n is 1024, the number of the display electrodes YP is 512. Supposing that the IC component has 64 scan ports, eight IC components are necessary.

In FIG. 4, the address electrodes A1 and A2 extend diagonally in the region between rows in order to avoid every other cell C arranged in the column direction. In this way, the address electrodes A1 and A2 are patterned in a meandering shape, so that the partition 29 can easily insulate the address electrodes A1 and A2 partially. The width of the partition 29 may be sufficient to cover an address electrode. In addition, the gap between the address electrodes A1 and A2 can be larger than that of the electrode structure shown in FIG. 3, to thereby suppress increase of capacitance between the electrodes. The address electrode A1 makes an electrode pair with a display electrode $Y_{odd}$ of an odd row $L_{odd}$, while the address electrode A2 makes an electrode pair with a display electrode $Y_{even}$ of an even row $L_{even}$.

Figure 5:
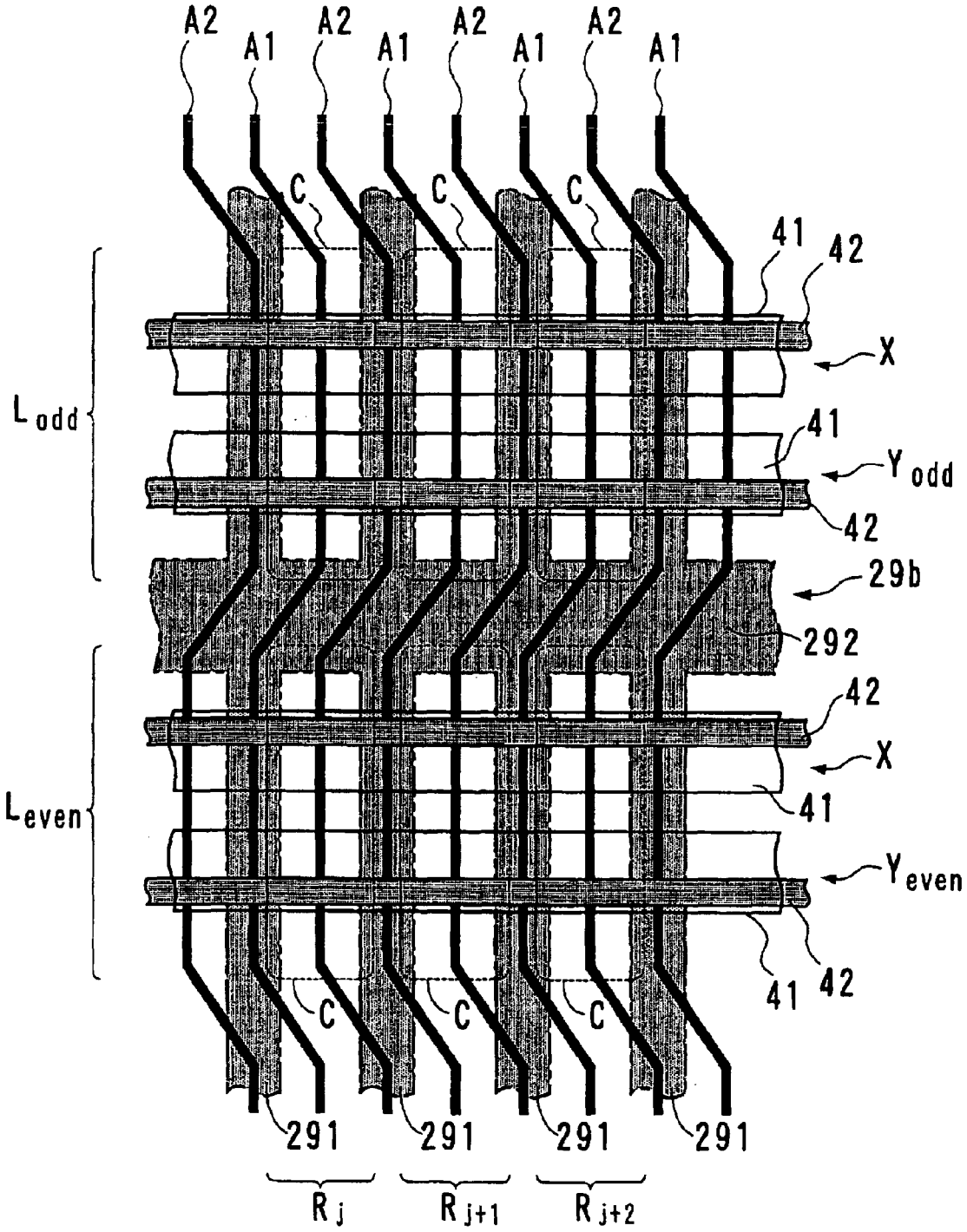
FIG. 5 is a plan view showing a variation of the partition structure.

FIG. 5 is a plan view showing a variation of the partition structure.

A partition 29*b* is an integrated structure of column direction walls 291 corresponding to the partitions 29 shown in FIG. 2 and row direction walls 292, having a grid shape in a plan view. The row direction wall 292 covers the bent portion of the address electrodes A1 and A2, so as to prevent a misdischarge in the bent portion. By making the row direction wall 292 lower than the column direction wall 291, inner air can be exhausted with a small resistance in an assembling process of the PDP 1.

Figure 6:
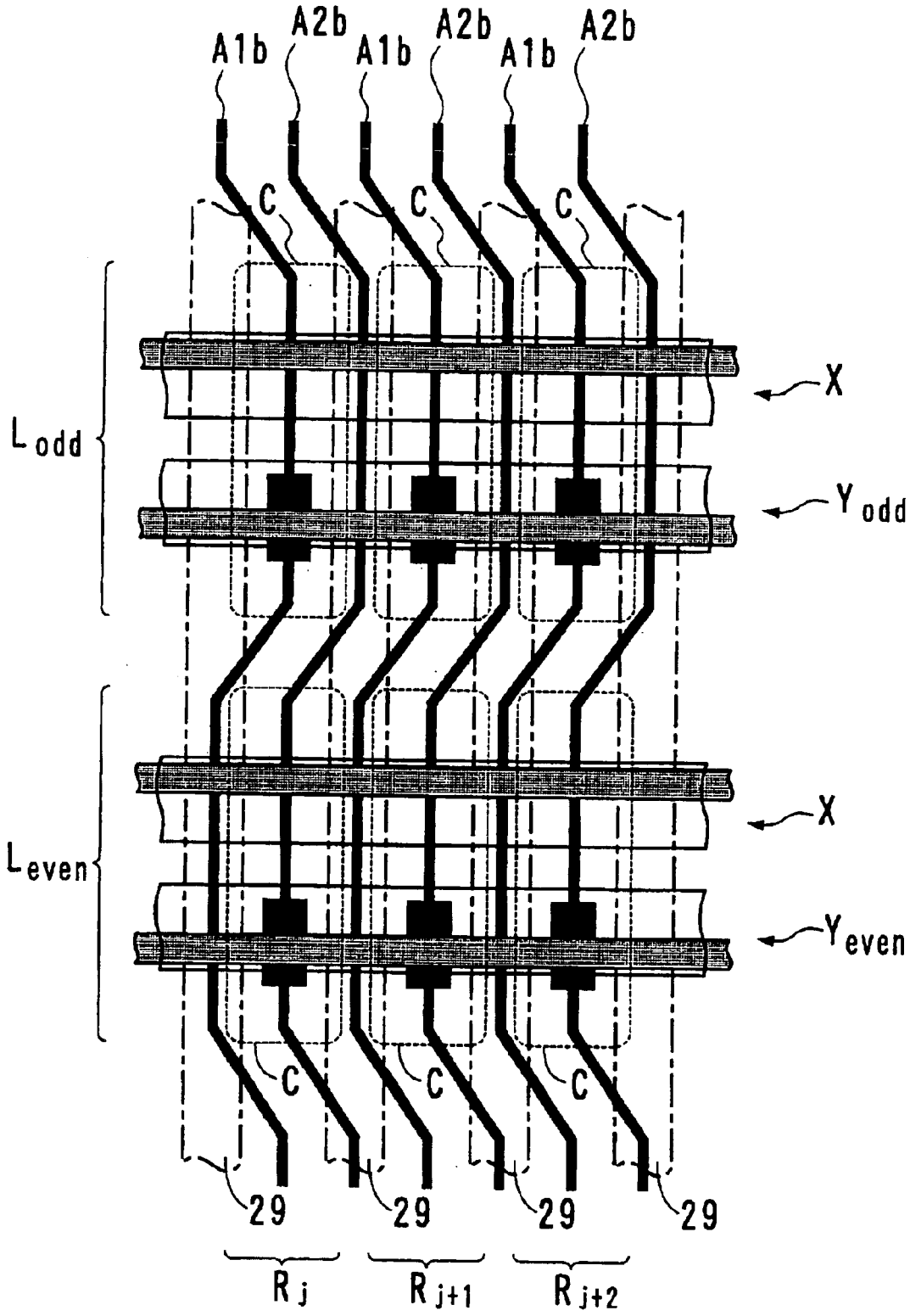
FIG. 6 is a plan view showing a first variation of an address electrode pattern.

FIG. 6 is a plan view showing a first variation of an address electrode pattern.

Address electrodes A1*b* and A2*b* have widened portions crossing the display electrode Y, where an address discharge is generated. Thus, the opposed area of the address electrode A1*b* or A2*b* to the display electrode Y increases so that a discharge probability is raised.

Figure 7:
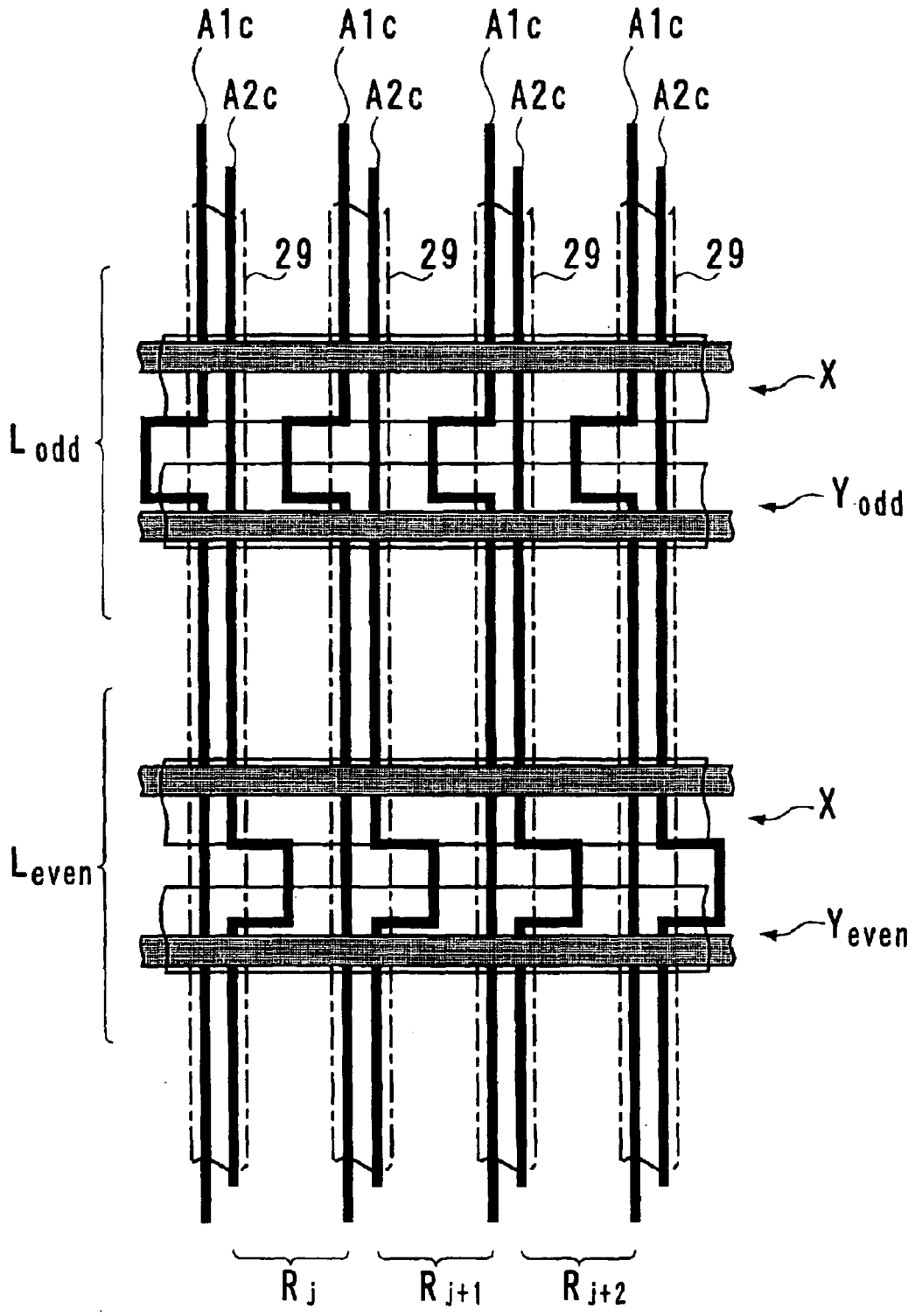
FIG. 7 is a plan view showing a second variation of the address electrode pattern.

FIG. 7 is a plan view showing a second variation of the address electrode pattern.

Address electrodes A1*c* and A2*c* have a band-like shape that is bent at every portion opposed to the display electrode Y constituting the electrode pair, and the regions between rows thereof are covered with partitions 29.

Figure 8:
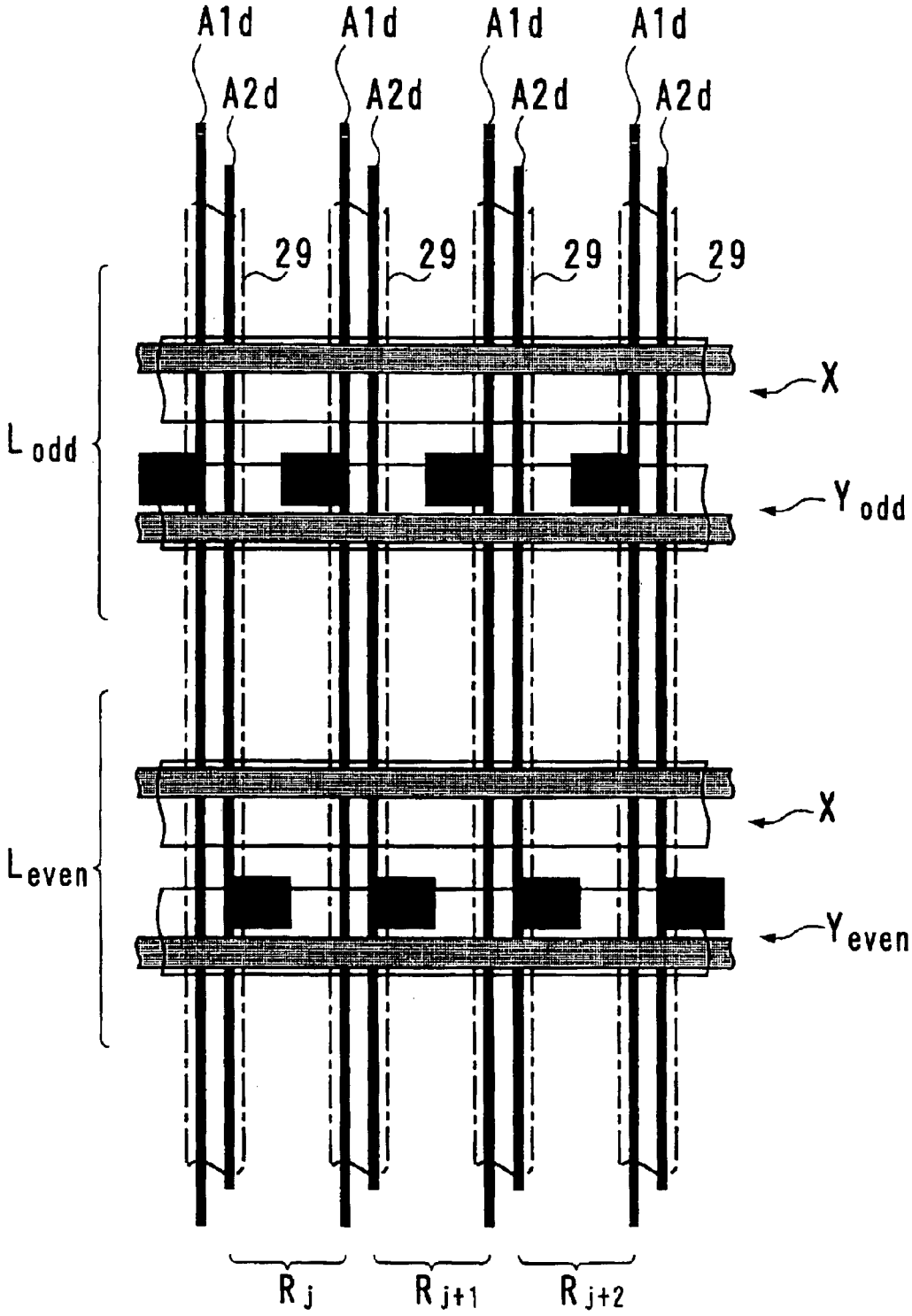
FIG. 8 is a plan view showing a third variation of the address electrode pattern.

FIG. 8 is a plan view showing a third variation of the address electrode pattern.

Address electrodes A1*d* and A2*d* have protruding portions that are opposed to the display electrodes Y constituting the electrode pair, and the regions between rows thereof are covered with partitions 29.

Figure 9:
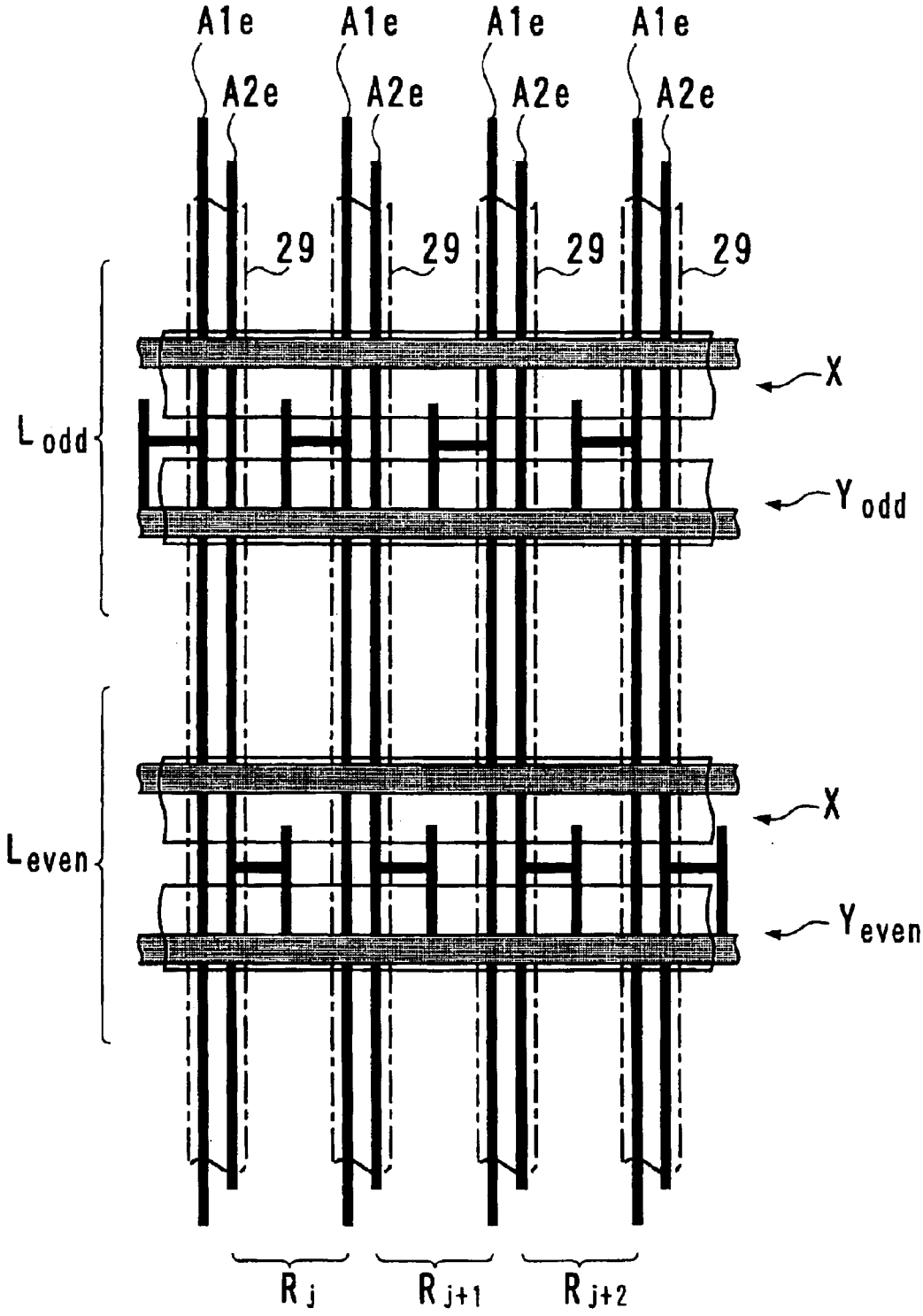
FIG. 9 is a plan view showing a fourth variation of the address electrode pattern.

FIG. 9 is a plan view showing a fourth variation of the address electrode pattern.

Address electrodes A1*e* and A2*e* have T-shaped protruding portions that are opposed to the display electrodes Y constituting the electrode pair, and the regions between rows thereof are covered with partitions 29. It is desirable in addressing a surface discharge type PDP to use the address discharge between the address electrode A1*e* or A2*e* and the display electrode Y as a trigger for generating another address discharge between the display electrode Y and the display electrode X. The pattern shown in FIG. 9 is suitable for suppressing undesired discharge in the region between rows and enlarging the address discharge from the display electrode Y to the display electrode X.

Hereinafter, a driving method applied to the PDP 1 will be explained.

Figure 10:
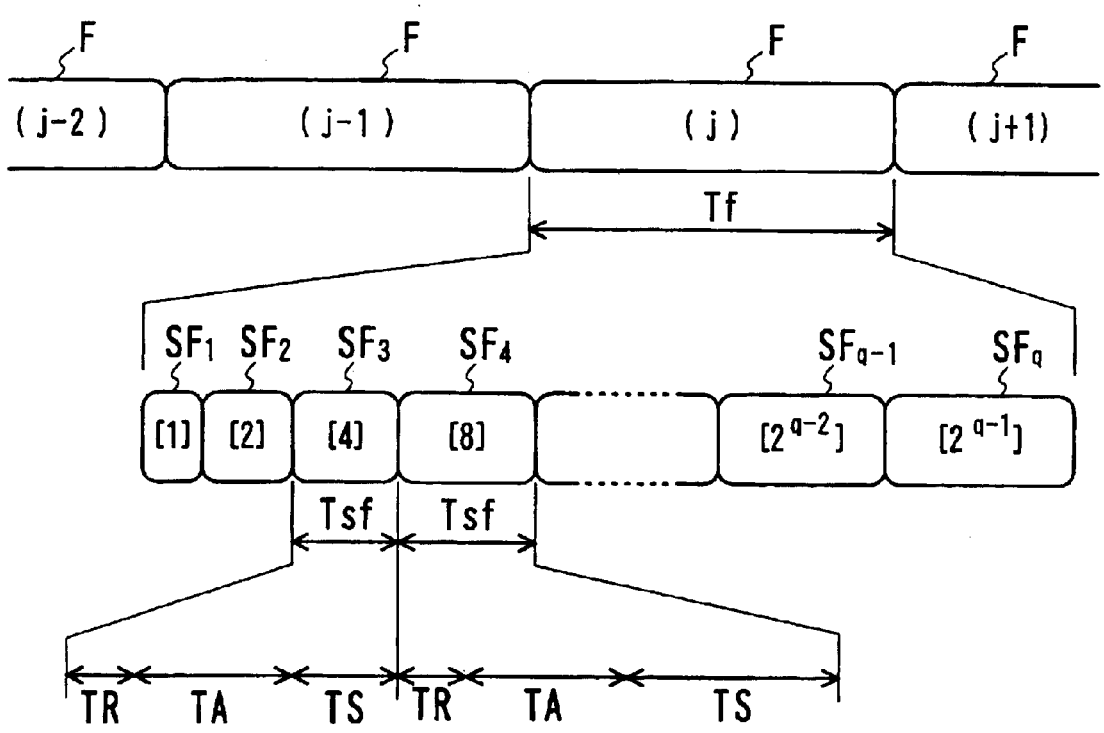
FIG. 10 is a diagram showing a concept of frame division.

FIG. 10 is a diagram showing a concept of frame division. In a display of PDP 1, color is reproduced by usual binary lighting control, so each frame F of an input image is divided into q subframes SF. In other words, each frame F is replaced with a set of q subframes SF. Weighting values of $2^0$, $2^1$, $2^2$, . . . and $2^q$ are assigned to the subframes SF in order to set the number of times of the display discharge for each subframe SF. By combining ON and OFF of each subframe, N ($=1+2^1+2^2+\ldots+2^q$) steps of luminance can be set for each of red, green and blue colors. The weighting values are not limited to powers of 2. Though the subframes are arranged in the weighting order in FIG. 10, they can be arranged in other orders. In addition, other lighting controls can be adopted. In accordance with this frame structure, the frame period Tf, which is a frame transferring period, is divided into q subframe periods Tsf, and one subframe period Tsf is assigned to each subframe SF. In addition, the subframe period Tsf is divided into plural periods, i.e., a reset period TR for initialization, an address period TA for addressing and a display period TS for lighting. Each of the reset period TR and the address period TA has a constant length regardless of the weight, while a length of the display period TS increases along with the weight. Therefore, a length of the subframe period Tsf also increases along with the weight of the subframe SF.

[First Driving Method]

Figure 11:
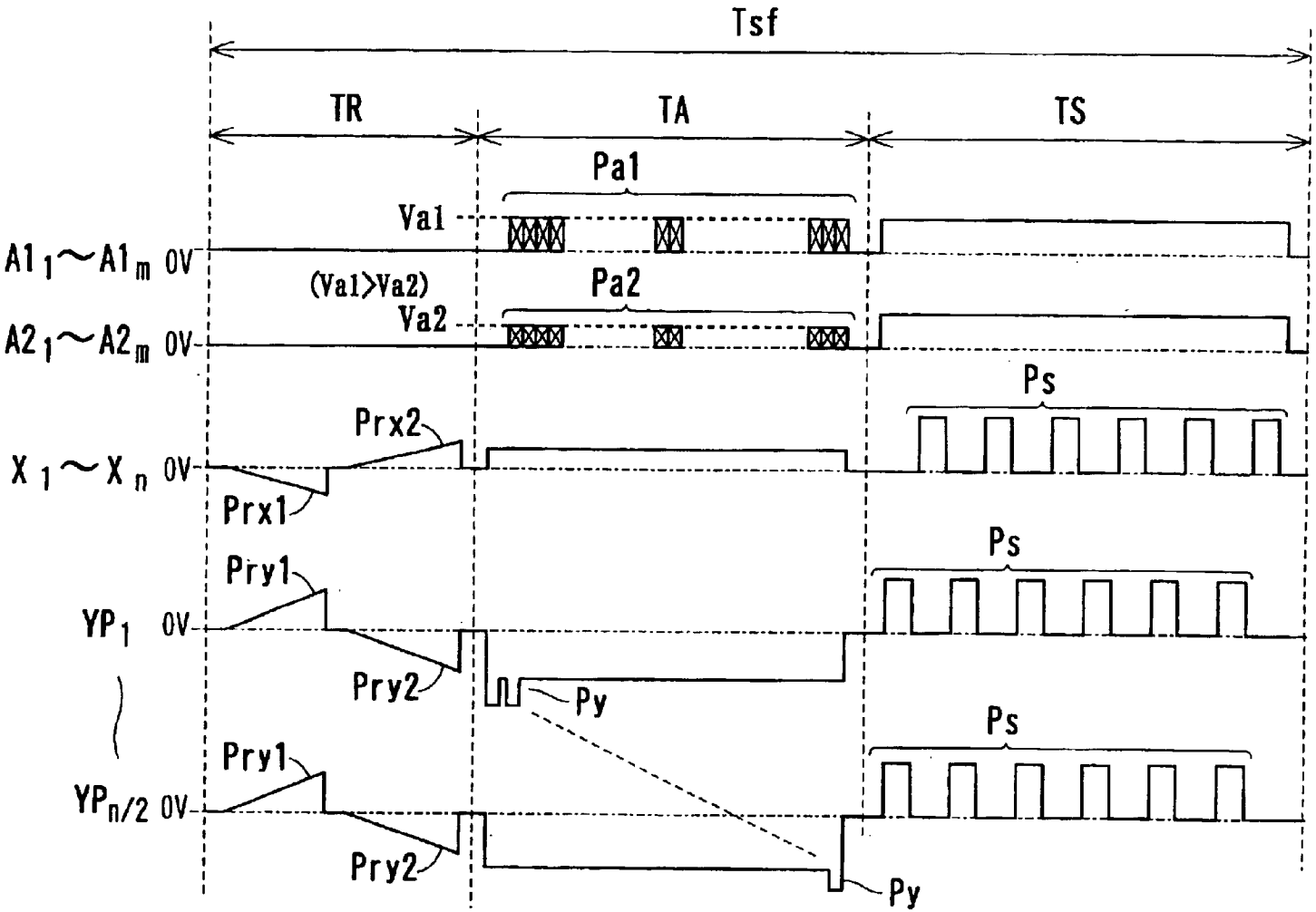
FIG. 11 is a diagram showing voltage waveforms in a first driving method.
Figure 12:
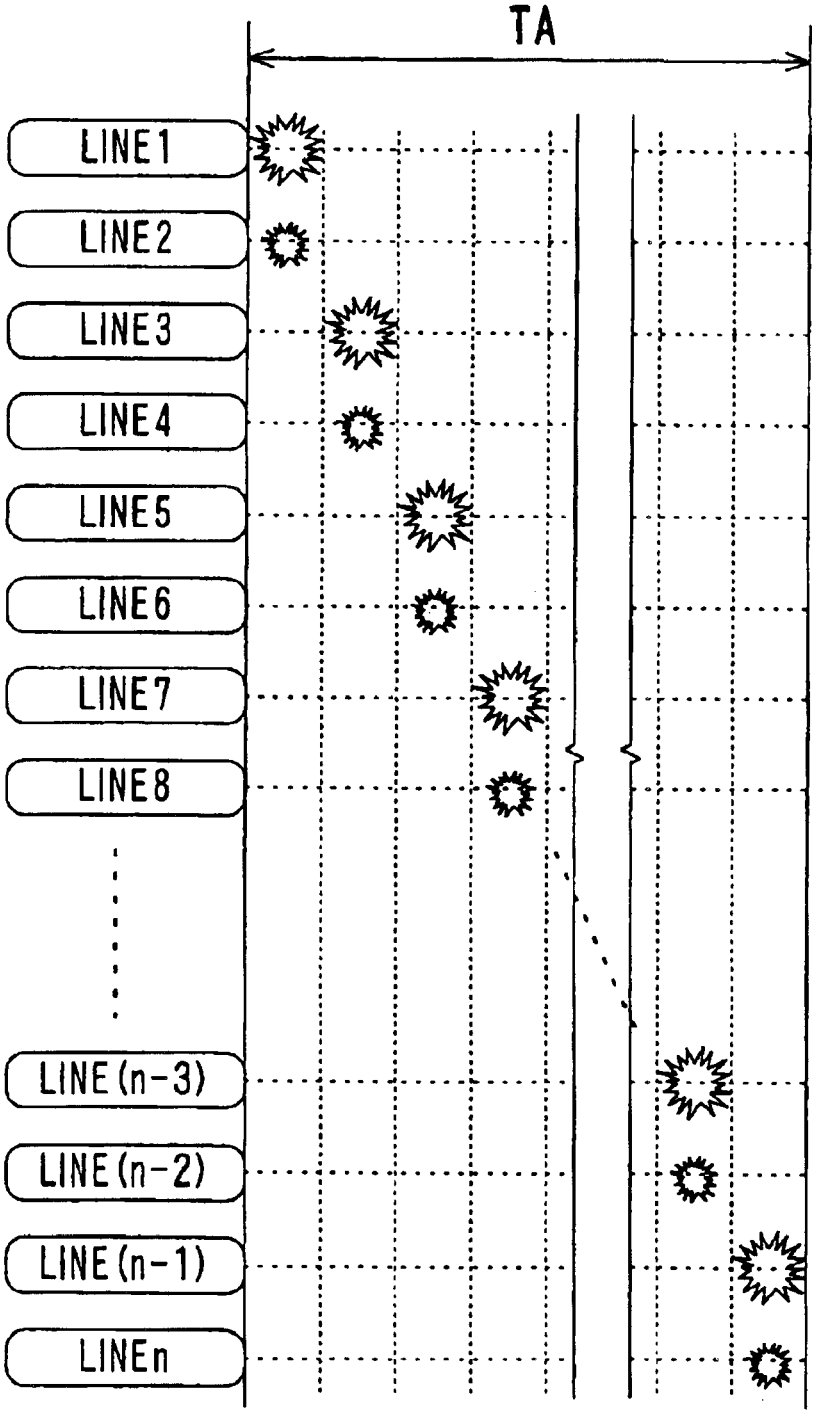
FIG. 12 is a diagram showing an address order of rows and intensity of the address discharge in the first driving method.

FIG. 11 is a diagram showing voltage waveforms in a first driving method. FIG. 12 is a diagram showing an address order of rows and intensity of the address discharge in the first driving method.

The order of the reset period TR, the address period TA and the display period TS is the same in q subframes SF, and the driving sequence is repeated for each subframe. In the reset period TR of each subframe SF, a negative pulse Prx1 and a positive pulse Prx2 are successively applied to all display electrodes X, while a positive pulse Pry1 and a negative pulse Pry2 are successively applied to all display electrodes YP. The pulses Prx1, Prx2, Pry1 and Pry2 are ramp waveform pulses whose amplitude increases at a rate generating a micro discharge. The pulses Prx1 and Pry1 are applied first for generating the appropriate wall voltage having the same polarity in all cells regardless of ON or OFF in the previous subframe. By applying the pulses Prx2 and Pry2 to the cells having the appropriate wall charge, the wall voltage can be adjusted to the value corresponding to the difference between a discharge starting voltage and the pulse amplitude. The initialization (i.e., equalization of charge) in this example erases wall charge of all cells so that the wall voltage becomes zero. Furthermore, the pulse for the initialization may be applied to only one of the display electrodes X and Y. However, if pulses having different polarities are applied to the display electrodes X and Y as shown in FIG. 11, a withstand voltage of driver circuit elements can be lowered. The driving voltage that is applied to the cell is the sum of the amplitudes of pulses that are applied to the display electrodes X and Y.

In the address period TA, the wall charge is formed for sustaining only in the cells to be lighted. All display electrodes X and all display electrodes YP are biased to a predetermined potential, and then a negative scan pulse Py is applied to one display electrode YP corresponding to the selected row at a constant interval. In synchronization with the row selection of this two rows, address pulses Pa1 and Pa2 are applied to the address electrodes A1 and A2 corresponding to the selected cell to generate the address discharge. In other words, the potentials of the address electrodes A1 and A2 are controlled in binary manner in accordance with the subframe data Dsf of the selected two rows and m columns. In the selected cell, a discharge is generated between the display electrode YP and the address electrode A1 or A2, and the discharge causes a surface discharge between the display electrodes. It is important that the amplitude Va1 of the address pulse Pa1 to be applied to the address electrode A1 and the amplitude Va2 of the address pulse Pa2 to be applied to the address electrode A2 should be set separately. In the illustrated example, the amplitude Va1 is greater than the amplitude Va2. The individual setting reduces a "cross talk" and increase reliability of the addressing. If the row selection is performed in the arrangement order, an address discharge of a row may affect an address discharge of another row to be selected next. As shown in FIG. 12, concerning two rows that are selected at the same time, the discharge intensity of the lower row in the scanning direction is set smaller than that of the upper row, so that the cross talk between the two rows and other two rows located at lower position in the scanning direction can be reduced.

In a sustaining period TS, a sustaining pulse Ps having predetermined polarity (positive polarity in the illustrated example) is applied to all display electrode YP first. Then, the sustaining pulse Ps is applied to the display electrode X and the display electrode YP alternately. The sustaining pulse Ps has an amplitude of sustaining voltage (Vs) lower than the discharge starting voltage. The application of the sustaining pulse Ps causes surface discharge in cells having predetermined quantity of wall charge remained. The number of application times of the sustaining pulse Ps corresponds to the weight of the subframe as mentioned above. Furthermore, the address electrodes A1 and A2 are biased to a potential having the same polarity as the sustaining pulse Ps during the sustaining period TS so as to prevent undesired discharge.

[Second Driving Method]

Figure 13:
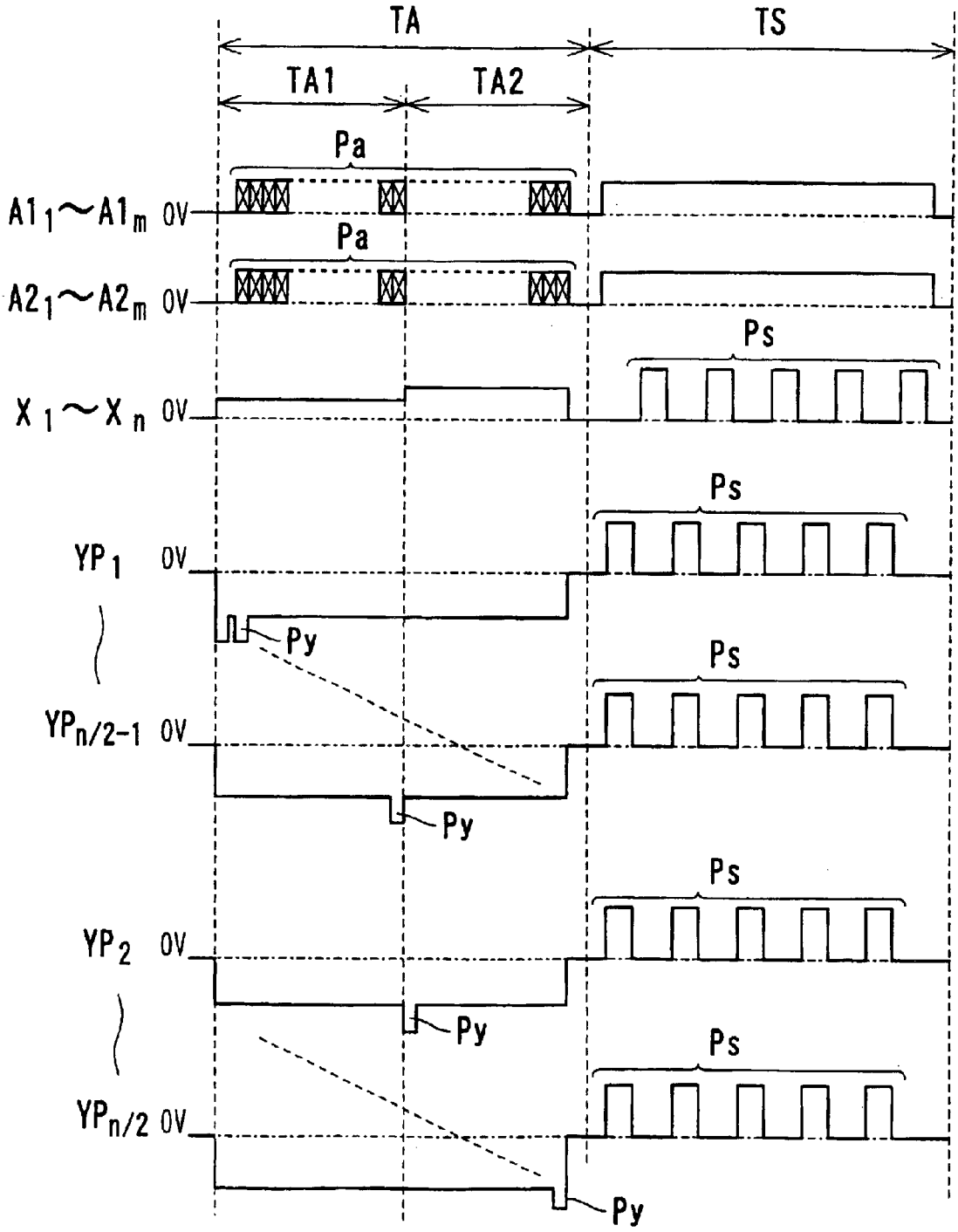
FIG. 13 is a diagram showing voltage waveforms in a second driving method.
Figure 14:
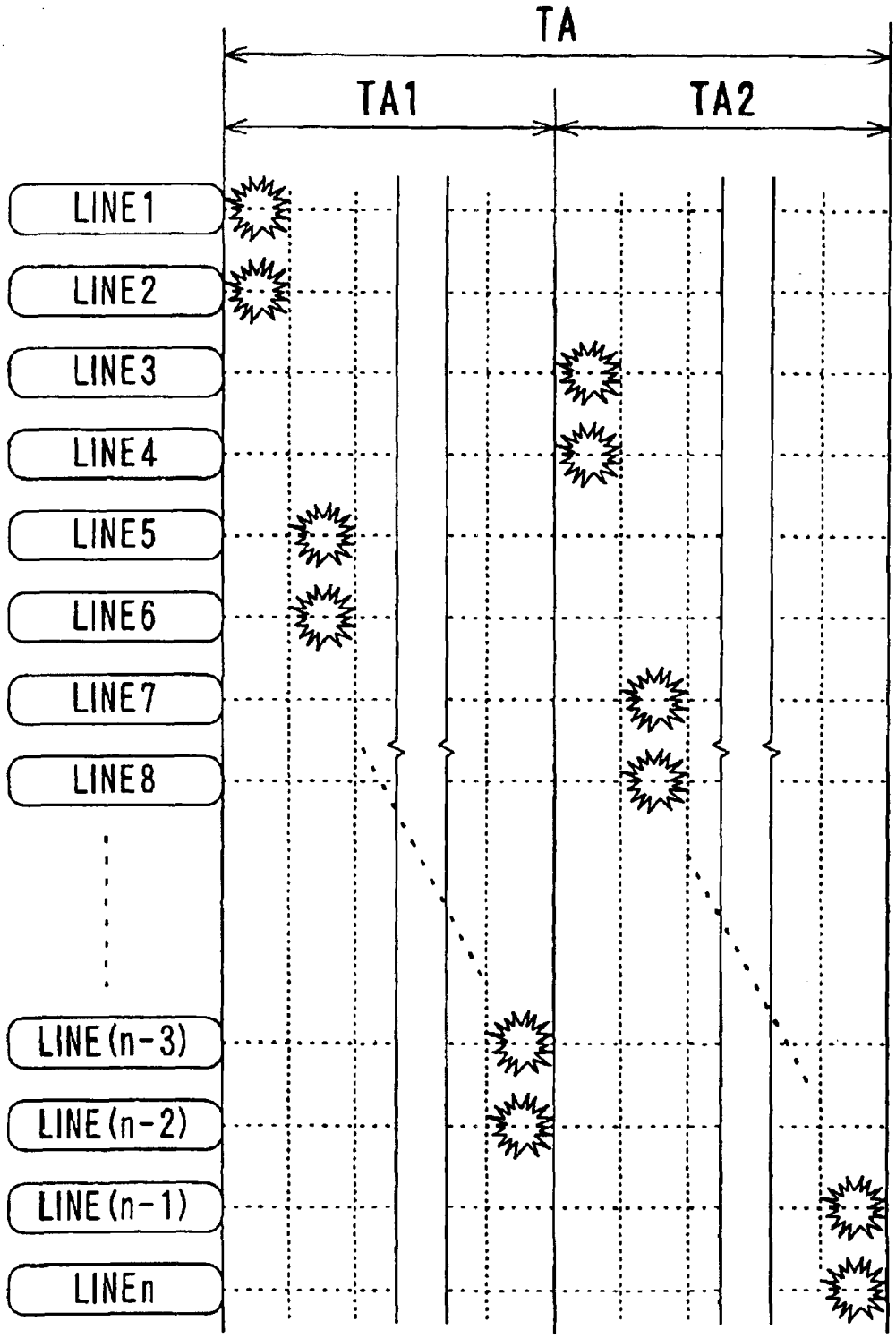
FIG. 14 is a diagram showing an address order of rows in the second driving method.

FIG. 13 is a diagram showing voltage waveforms in a second driving method. FIG. 14 is a diagram showing an address order of rows in the second driving method.

The address period TA is divided into two periods, i.e., the first period TA1 and the second period TA2. In the first period TA1, the scan pulse Py is successively applied to odd display electrodes YP noting only display electrode YP in the display electrode columns. In synchronization with the row selection, the address pulse Pa is applied to the address electrodes A1 and A2 so as to perform the addressing at the interval of two rows as shown in FIG. 14. In the second period TA2, the scan pulse Py is successively applied to even display electrodes YP, so as to perform the addressing of the rows that were not selected in the first period TA1. The bias potential of the display electrode X is optimized for the first period TA1 and the second period TA2 separately.

[Second Embodiment]

The structure of the PDP in a second embodiment is the same as that of the PDP 1 in the first embodiment except for the shape of the address electrode in a plan view and connection form of the display electrodes.

Figure 15:
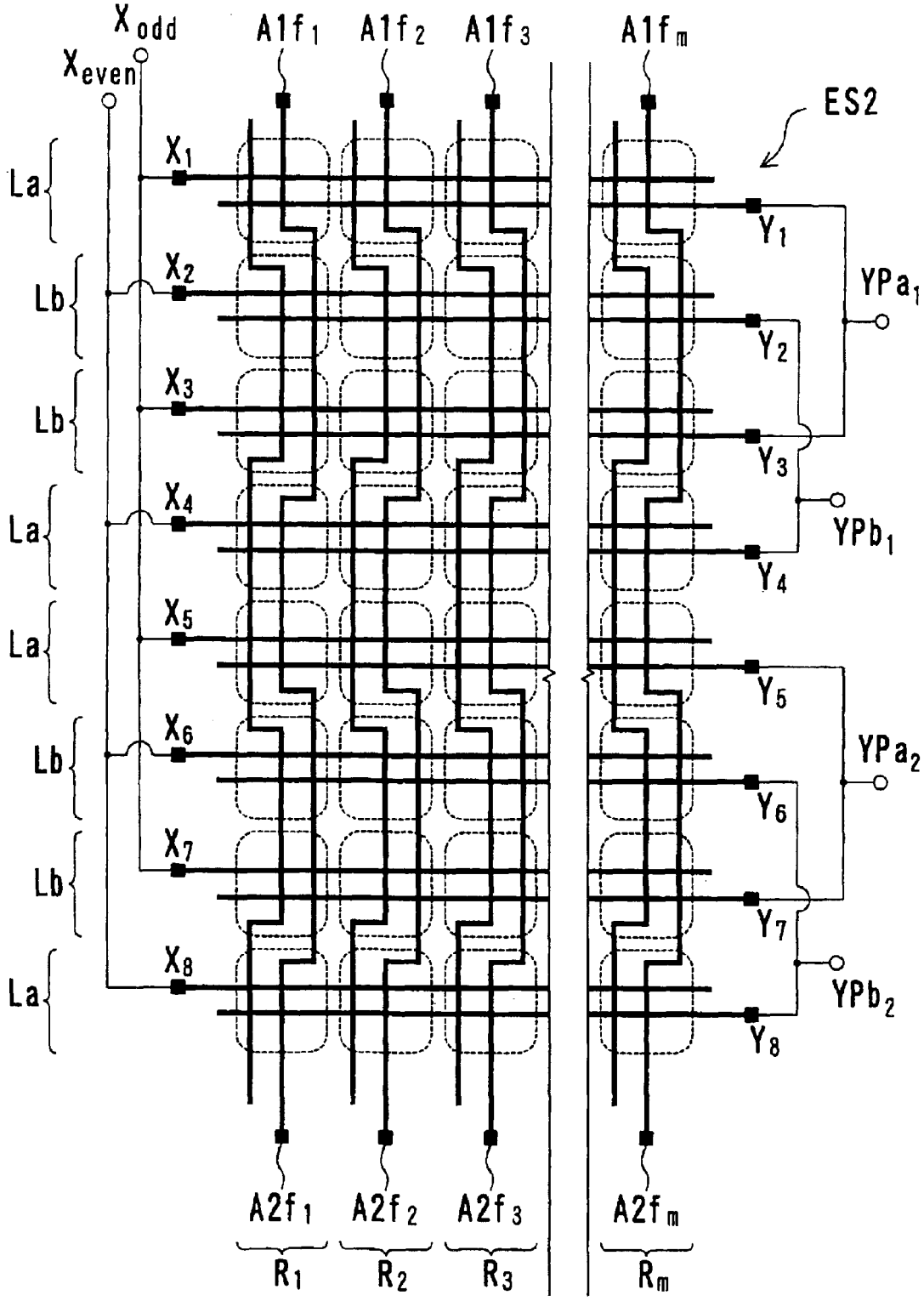
FIG. 15 is a schematic diagram of the electrode structure according to a second embodiment.

FIG. 15 is a schematic diagram of the electrode structure according to the second embodiment.

The display screen ES2 comprises rows La of the first group and rows Lb of the second group. However, this grouping is performed for convenience of discriminating the relationship between the row and address electrode, and there is no functional difference between the row La and the row Lb. The row La is a first, a 4i-th (i=1, 2, 3, . . . ), or a (4i+1)th row, while the row Lb is a (4i−2)th or a (4i−1)th row. In each column $R_1$, $R_2$, $R_3$, . . . or $R_m$, each of the two address electrodes A1*f* and A2*f* is a band-like conductor being bent regularly and is continuous from one end of the column to the other end. The address electrode A1*f* crosses the display electrode Y corresponding to the row La at the position where the partition (not shown) does not insulate and crosses the display electrode Y corresponding to the row Lb at the position where the partition insulates. On the contrary, the address electrode A2*f* crosses the display electrode Y corresponding to the row La at the position where the partition insulates and crosses the display electrode Y corresponding to the row Lb at the position where the partition does not insulate. In other words, the address electrode A1*f* is patterned so as to generate the address discharge only in the rows La, while the address electrode A2*f* is patterned so as to generate the address discharge only in the rows Lb.

In the second embodiment, one of the rows La and one of the rows Lb are selected simultaneously for addressing, thereby to shorten the addressing period. As shown in FIG. 15, each display electrode Y is connected to another display electrode Y that belongs to another group and is the closest, in the order from one end of the arrangement, so as to form display electrodes YPa and YPb, which are two scan electrodes. This connection can be realized by a double layered wiring. If a double-sided print wiring board is used for the connection of the PDP and the driving circuit, the double layered wiring on the glass substrate is not required. By this connection, the number of IC components constituting the Y-driver can be reduced, and a countermeasures against EMI can be taken as being explained below.

Figure 16:
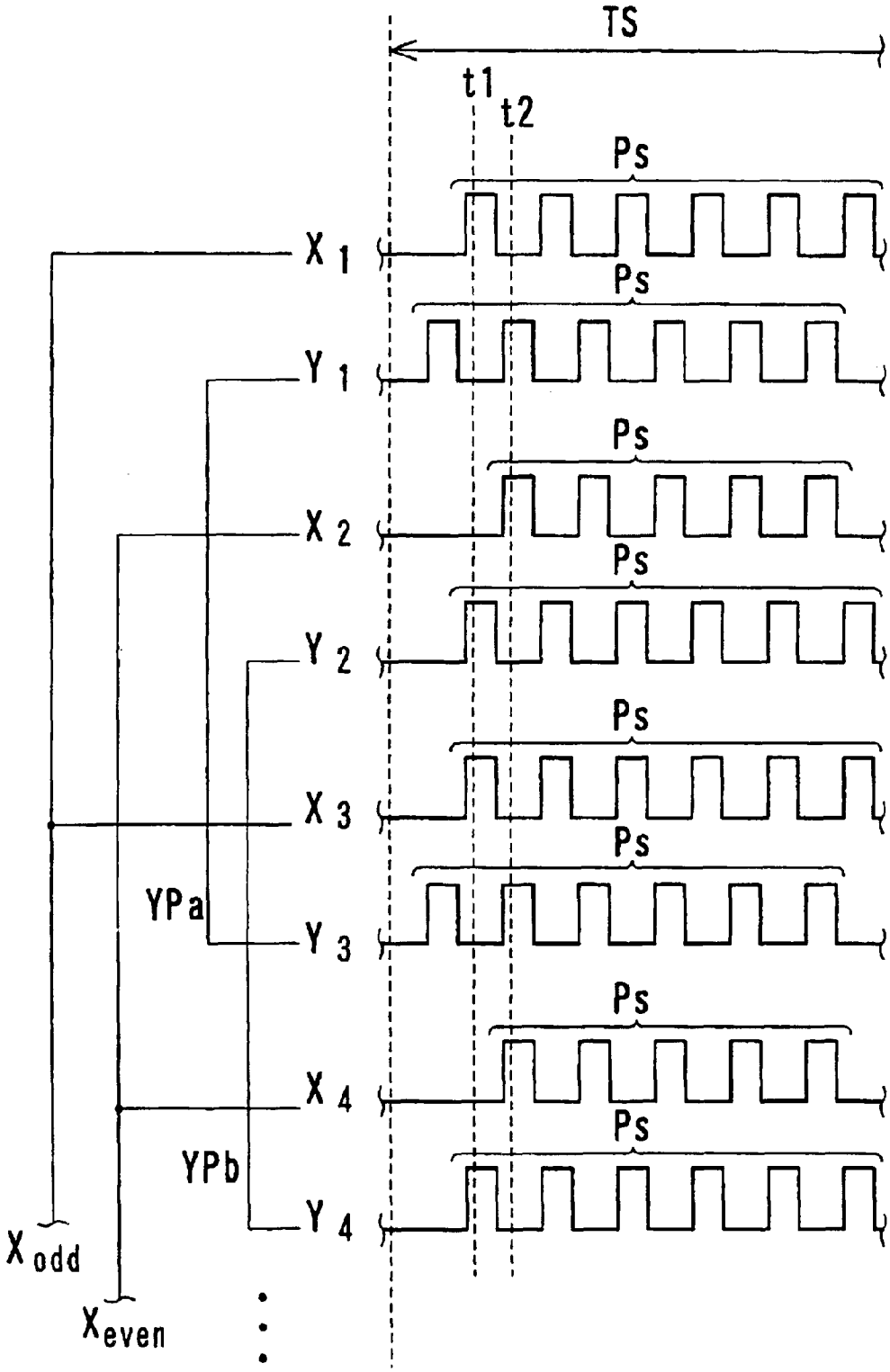
FIG. 16 is a diagram showing an application timing of the sustaining pulse according to the second embodiment.
Figure 17A:
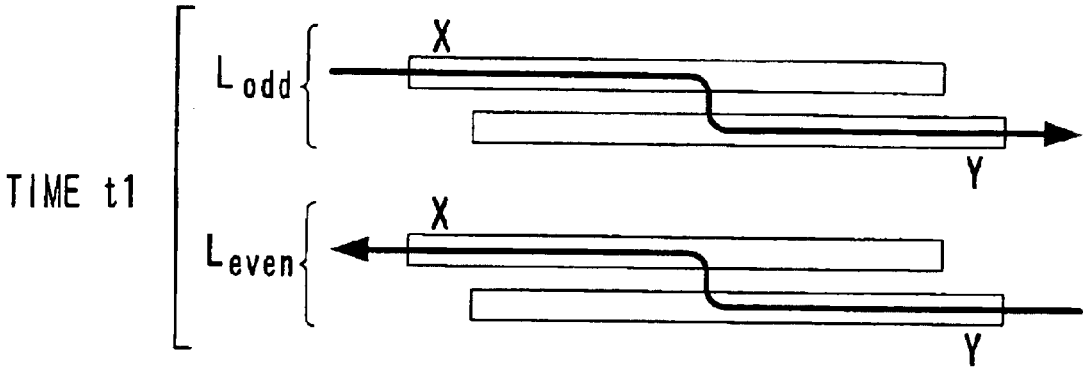
FIGS. 17A and 17B are diagrams each showing a direction of display discharge current flowing through the display electrode.
Figure 17B:
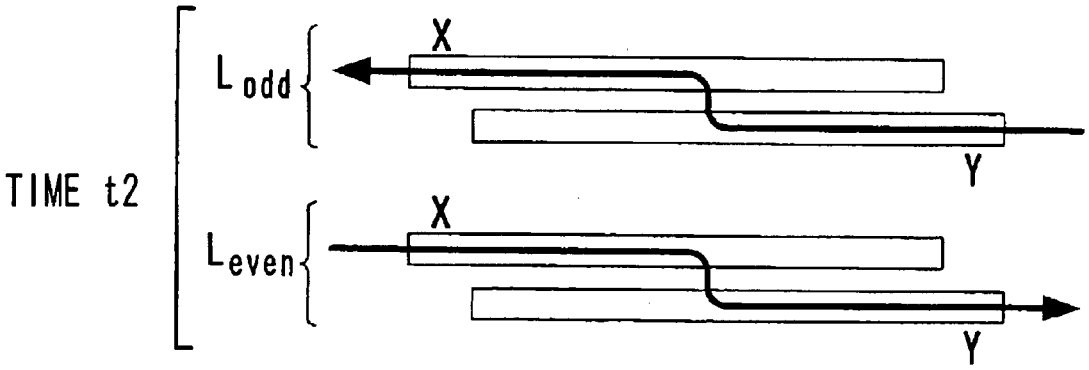

FIG. 16 is a diagram showing an application timing of the sustaining pulse according to the second embodiment. FIG. 17 is a diagram showing a direction of display discharge current flowing through the display electrode.

During the sustaining period, the sustaining pulse Ps is applied to the display electrode X and the display electrode Y alternately so as to generate display discharge periodically. On this occasion, the sustaining pulse Ps is applied to the odd display electrode $X_{odd}$ and the even display electrode $X_{even}$ at timings different from each other by half a period. Then, the sustaining pulse Ps is applied to the odd display electrode Y (the display electrode YPa) at the same timing as the display electrode $X_{even}$ when only display electrodes Y are counted, while the sustaining pulse Ps is applied to the even display electrode Y (the display electrode YPb) at the same timing as the display electrode $X_{odd}$. Thus, as shown in FIG. 17, the current direction of the odd row $L_{odd}$ is opposite to that of the even row $L_{even}$, thereby canceling magnetic fields generated by the currents by each other between the rows. Since the current direction of each row is reversed at every discharge, the reverse of the current direction occurs in the other row at the same time. Therefore, the magnetic fields are always canceled.

[Third Embodiment]

Figure 18:
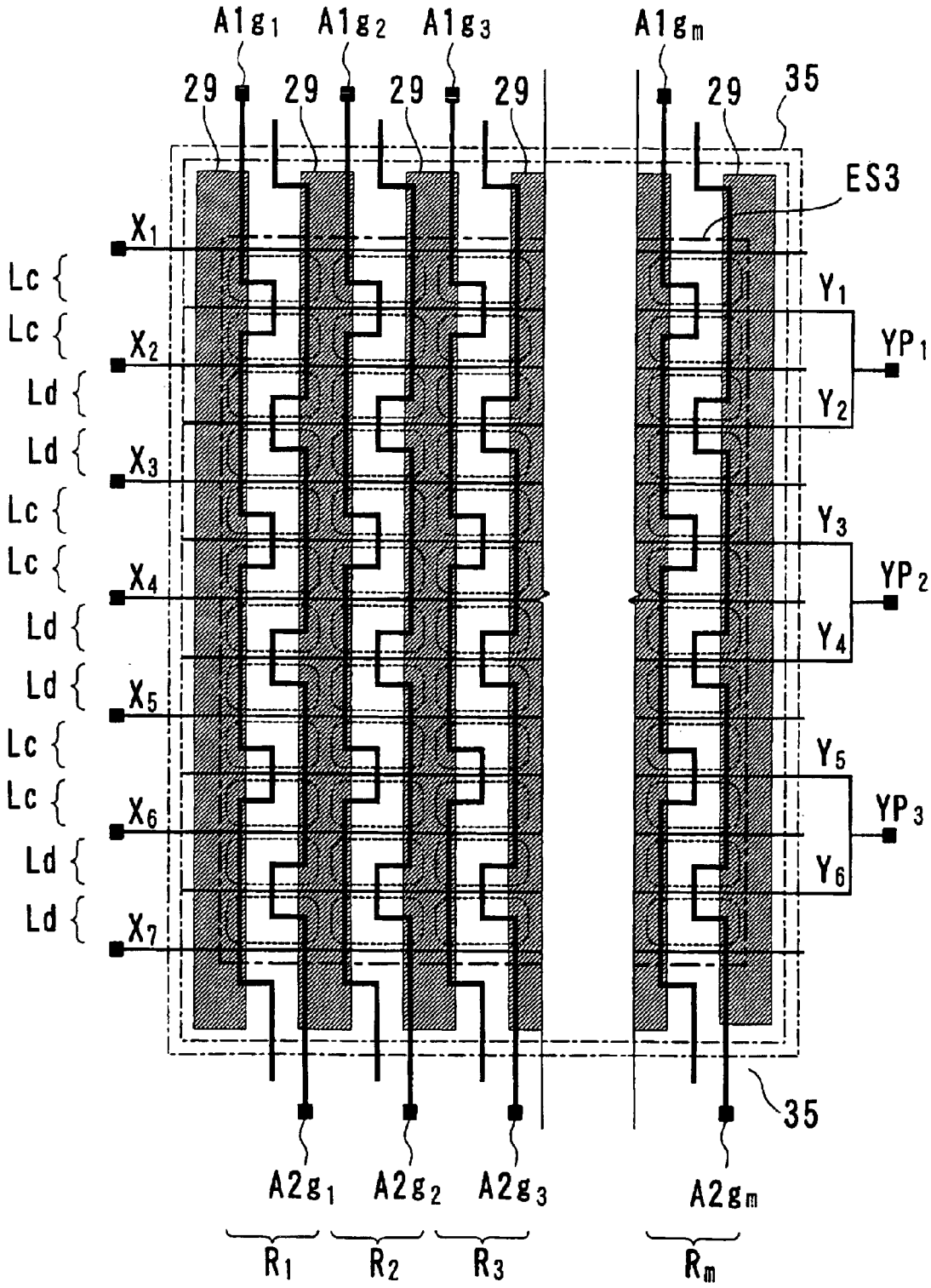
FIG. 18 is a schematic diagram of the electrode structure according to a third embodiment.
Figure 19:
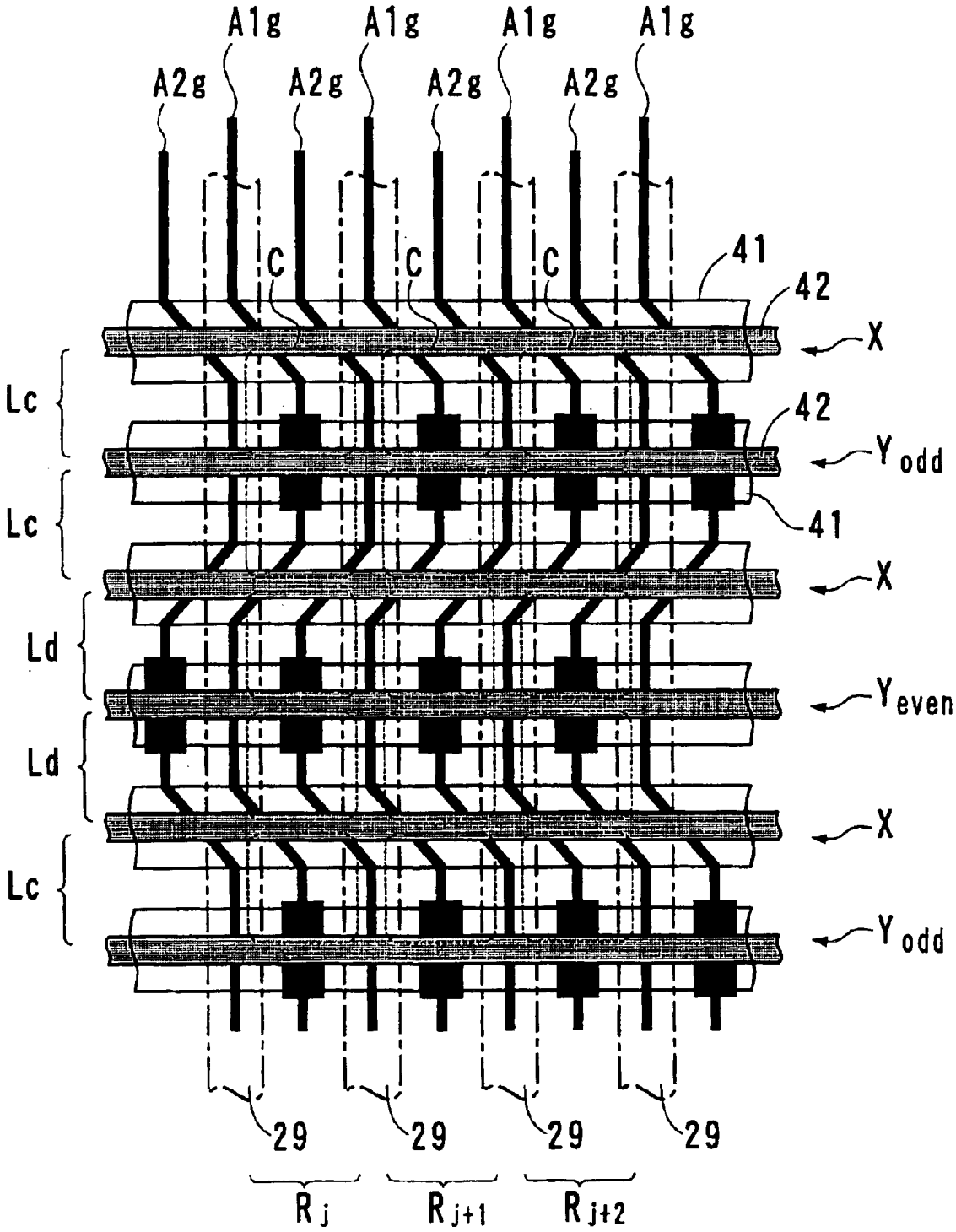
FIG. 19 is a plan view showing details of the electrode structure according to the third embodiment.
Figure 20A:
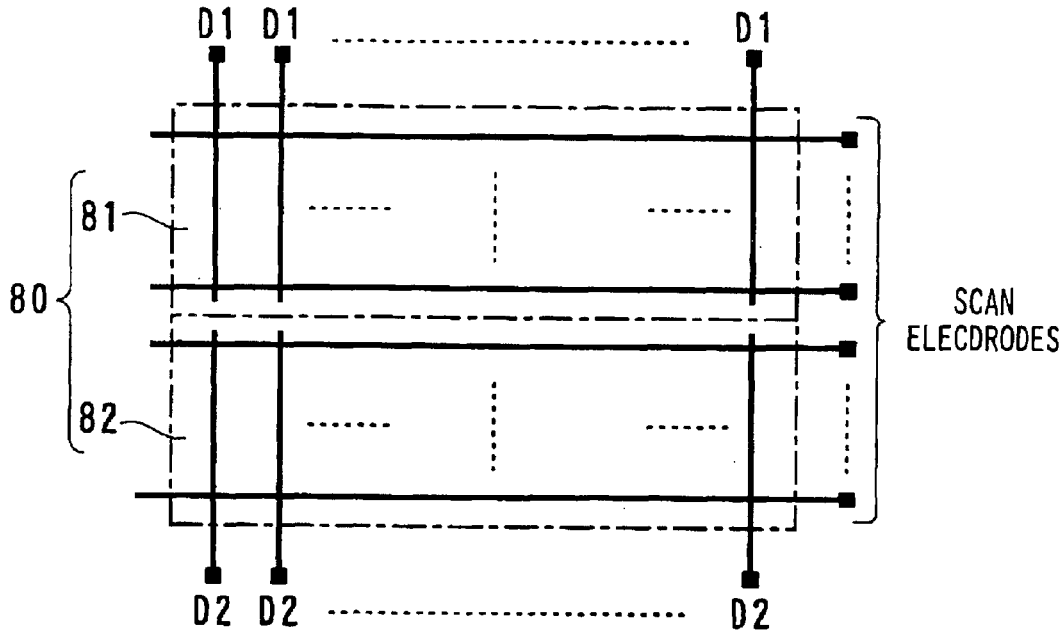
FIG. 20A PRIOR ART
FIGS. 20A and 20B are schematic diagrams of the electrode structure of the conventional PDP.
Figure 20B:
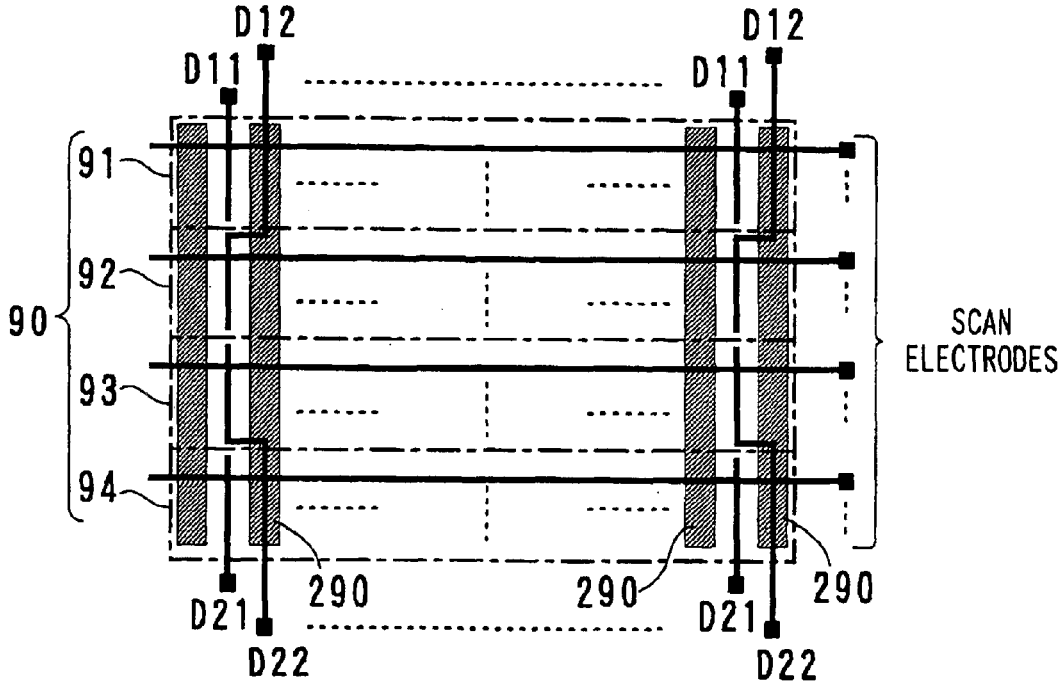
FIG. 20B PRIOR ART

FIG. 18 is a schematic diagram of the electrode structure according to a third embodiment. FIG. 19 is a plan view showing details of the electrode structure according to the third embodiment.

The PDP of the third embodiment is a surface discharge type having display electrodes X and Y arranged alternately in a constant pitch. The total number of the display electrodes X and Y is the number of rows n plus one, and the display electrodes X and Y except both ends of the arrangement correspond to the two neighboring rows.

The display screen ES3 comprises rows Lc of the first group and rows Ld of the second group. However, this grouping is also classification for convenience in the same way as the above-mentioned example. The row Lc is a (4i−3)th or a (4i−2)th row when i denotes an integer, while the row Ld is a (4i−1)th or a 4i-th row. In each column $R_1$, $R_2$, $R_3$, . . . or $R_m$, each of the two address electrodes A1*g* and A2*g* is a band-like conductor being bent regularly and is continuous from one end of the column to the other end. The address electrode A1*g* crosses the display electrode Y corresponding to the row Lc at the position where the partition 29 does not insulate and crosses the display electrode Y corresponding to the row Ld at the position where the partition 29 insulates. On the contrary, the address electrode A2*g* crosses the display electrode Y corresponding to the row Lc at the position where the partition 29 insulates and crosses the display electrode Y corresponding to the row Ld at the position where the partition 29 does not insulate. In other words, the address electrode A1*g* is patterned so as to generate the address discharge only in the rows Lc, while address electrode A2*g* is patterned so as to generate the address discharge only in the row Ld.

The total number of the display electrodes Y in the third embodiment is substantially a half of that in the case where a pair of display electrodes is arranged for each row. According to the present invention, two display electrodes Y can make a set (a common display electrode). Therefore, the substantial number of the scan electrodes can be reduced to half a number of the display electrodes Y. As shown in FIG. 18, each display electrode Y is connected to another display electrode Y that belongs to another group and is the closest, in the order from one end of the arrangement, so as to form the display electrode YP that is common for two rows. This connection can be realized by a single layered wiring.

As shown in FIG. 19, since the address electrodes A1*g* and A2*g* have meandering shapes, the partition 29 can easily insulate the address electrodes A1*g* and A2*g* partially. The width of the partition 29 may be sufficient to cover an address electrode. The address electrode A1*g* has wide portions at intersections with odd display electrodes $Y_{odd}$, while the address electrode A2*g* has wide portions at intersections with even display electrodes $Y_{even}$. Thus, the opposed area to the display electrode Y increases so that a discharge probability is raised.

In the above-mentioned embodiments, the both ends of the address electrodes A1, A1*b*–A1*g*, A2 and A2*b*–A2*g* are led out of the sealing member 35. Therefore, when a break of an electrode occurs, the broken electrode can be connected electrically outside the sealing member 35 to be repaired.

It is possible to arrange three or more address electrodes in each column of the display screen so that three or more address electrodes can be selected at the same time.

According to the present invention, circuit elements necessary for controlling potentials of scan electrodes can be reduced without using a complicated multilayered wiring.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A plasma display panel, comprising:

scan electrodes to select respective rows of a matrix display;

data electrodes to select respective columns of the matrix display;

a partition to define a discharge space at least for each column;

two of the data electrodes being arranged for each column of the matrix display, the data electrode being continuous from one end of the column to another end thereof;

all the scan electrodes within a display screen being classified into two groups, each of the two groups being assigned to each of the two data electrodes in each column; and each of the data electrodes being formed in a meandering shape so that each of the data electrodes being crossed with scan electrodes, belonging to the group that is assigned to the data electrode, such that the data electrode have first portions and second portions, the first portions being crossed with the scan electrodes belonging to the assigned group and not overlapping the partition and second portions being crossed with the scan electrodes belonging to the group that is not assigned to the data electrode and overlapping the partition.

2. The plasma display panel according to claim 1, wherein two of the scan electrodes, each of which is selected from each of the two groups within the display screen, are connected electrically.

3. The plasma display panel according to claim 1, wherein both ends of all data electrodes are led out of a sealing member that surrounds the display screen so as to close the discharge space.

4. The plasma display panel according to claim 1, wherein each of the data electrodes is widened locally in a plan view at portions thereof crossed with or opposed to scan electrodes belonging to the group that is assigned to the data electrode.

5. A method of driving a plasma display panel having scan electrodes to select respective rows of a matrix display, data electrodes to select respective columns of the matrix display, and a partition to define a discharge space at least for each column, comprising:

arranging two data electrodes for each column of the matrix display, each data electrode being continuous from the first end of the column to the second end of the column;

classifying all the scan electrodes within a display screen into two groups, and assigning each of the two groups to each of the two data electrodes in each column;

forming each data electrode in a meandering shape so as to set each data electrode to cross scan electrodes, belonging to the group that is assigned to the data electrode, such that the data electrode have first portions and second portions, the portions being crossed with the scan electrodes belonging to the assigned group and not overlapping the partition and the second portions being crossed with the scan electrodes belonging to the group that is not assigned to the data electrode and overlapping the partition;

connecting electrically two of the scan electrodes, each of which is selected from each of the two groups within the display screen; and selecting simultaneously two rows corresponding to the scan electrodes connected electrically when potentials of the scan electrodes and data electrodes are controlled in accordance with display contents for addressing.

6. The method according to claim 5, wherein the selecting comprises:

selecting two rows from one end of a row arrangement to another end thereof; and setting different potentials for the data electrode corresponding to a row that is closest to the second end of the column and the data electrode corresponding to a row that is closest to the first end of the column among the two rows to be selected simultaneously.

7. A plasma display panel, comprising:

a plurality of scan electrodes to select respective rows of a matrix display;

a plurality of data electrodes to select respective columns of the matrix display;

a plurality of partitions to define discharge spaces at least for each column;

the plurality of data electrodes being divided into sets of a common number of the data electrodes, each of the sets of the common number of the data electrodes being arranged, to interact in a respective column, each of the data electrodes having a meandering shape that is continuous from one end of the column to another end thereof;

the plurality of scan electrodes being arranged into a plurality of groups such that individual data electrodes of each of the sets are arranged to interact with a respective one of the scan electrodes in each of the groups; and the individual data electrodes of each of the sets being crossed with or opposed to the respective one of the scan electrodes in each of the groups, and at portions crossed with or opposed to the respective one of the scan electrodes does not overlap a respective partition and the individual data electrodes of each of the sets being crossed with or opposed to remaining ones of the scan electrodes in each of the groups, and at other portions crossed with or opposed to the other scan electrodes overlaps the respective partition.

8. The plasma display panel according to claim 7, wherein the scan electrodes in each of the groups are connected electrically.

9. The plasma display panel according to claim 7, wherein both ends of all data electrodes are led out of a sealing member that surrounds the display screen so as to close the discharge space.

10. The plasma display panel according to claim 7, wherein the individual data electrodes of each of the sets is wider at the portions being crossed with or opposed to the respective one of the scan electrodes in each of the respective groups which do not overlap the respective partition.

11. A method of driving a plasma display panel having a plurality of scan electrodes to select respective rows of a matrix display, a plurality of data electrodes to select respective columns of the matrix display, a plurality of partitions to define discharge spaces at least for each column, comprising:

dividing the plurality of data electrodes into sets of a common number of the data electrodes;

arranging each of the sets of the common number of the data electrodes to interact in a respective column, each of the data electrodes having a meandering shape that is continuous from the first end of the column to the second end of the column;

arranging the plurality of scan electrodes into a plurality of groups such that individual data electrodes of each of the sets are arranged to interact with a respective one of the scan electrodes in each of the groups;

crossing or opposing the individual data electrodes of each of the sets with a respective one of the scan electrodes in each of the groups, and at portions, crossing or opposing the individual date electrodes of each of the sets with the respective one of the scan electrodes in each of the groups, the respective one of the scan electrodes does not overlap a respective partition;

crossing or opposing the individual data electrodes of each of the sets with remaining respective ones of the scan electrodes in each of the groups and at other portions, crossing or opposing the individual data electrodes of each of the sets with the remaining respective ones of the scan electrodes in each of the groups, the respective remaining respective ones of the scan electrodes overlap the respective partition;

connecting electrically the scan electrodes in each of the groups; and selecting simultaneously rows corresponding to the scan electrodes connected electrically when potentials of the scan electrodes and data electrodes are controlled in accordance with display contents for addressing.

12. The method according to claim 11, wherein the selecting comprises:

selecting a number of rows in accordance with the common number of the data electrodes; and setting different potentials for a data electrode corresponding to a row that is closest to the second end of the column and the data electrode corresponding to a row that is closest to the first end of the column from among the rows selected simultaneously.

* * * * *

UNITED STATES PATENT AND TRADEMARK OFFICE

CERTIFICATE OF CORRECTION

PATENT NO. : 6,903,709 B2
DATED : June 7, 2005
INVENTOR(S) : Tatsuhiko Kawasaki et al.

It is certified that error appears in the above-identified patent and that said Letters Patent is hereby corrected as shown below:

Column 10,
Line 15, after "partition and" insert -- the --.
Line 49, after "the" insert -- first --.

Column 11,
Line 15, after "arranged" delete ",".

Column 12,
Line 19, replace "date" with -- data --.

Signed and Sealed this

Twenty-eighth Day of February, 2006

JON W. DUDAS
*Director of the United States Patent and Trademark Office*